US006626015B1

(12) United States Patent
Rapoport et al.

(10) Patent No.: US 6,626,015 B1
(45) Date of Patent: Sep. 30, 2003

(54) BEAKER TYPE DYEING MACHINE

(75) Inventors: Lev Rapoport, Yardley, PA (US); Leonard D. Butler, New Egypt, NJ (US)

(73) Assignee: Applied Color Systems, Inc., Lawrenceville, NJ (US)

( * ) Notice: Subject to any disclaimer, the term of this patent is extended or adjusted under 35 U.S.C. 154(b) by 83 days.

(21) Appl. No.: 09/724,210

(22) Filed: Nov. 28, 2000

(51) Int. Cl.[7] ..... D06B 23/10
(52) U.S. Cl. ..... 68/147; 68/171; 68/207
(58) Field of Search ..... 68/207, 13 R, 68/147, 152, 171; 222/144, 144.5; 141/104, 163, 237, 243, 270, 164, 180

(56) References Cited

U.S. PATENT DOCUMENTS

| | | | | |
|---|---|---|---|---|
| 1,366,116 | A | * | 1/1921 | Capell |
| 1,471,945 | A | * | 10/1923 | Charles et al. |
| 1,487,414 | A | * | 3/1924 | Weatherhead |
| 2,072,323 | A | * | 3/1937 | Wentz |
| 2,094,702 | A | * | 10/1937 | Hexter |
| 2,353,523 | A | * | 7/1944 | Stewart et al. |
| 2,374,430 | A | * | 4/1945 | Hexter |
| 2,699,283 | A | * | 1/1955 | Okulitch et al. |
| 2,923,438 | A | | 2/1960 | Logan et al. |
| 2,951,617 | A | | 9/1960 | De Brock |
| 2,979,066 | A | | 4/1961 | Christie |
| 3,042,259 | A | | 7/1962 | Engel |
| 3,166,107 | A | * | 1/1965 | Swenson et al. |
| 3,319,830 | A | | 5/1967 | Ward |
| 3,323,337 | A | * | 6/1967 | Graziano |
| 3,348,774 | A | | 10/1967 | Wiggins |
| 3,379,038 | A | | 4/1968 | Blancafort |
| 3,398,858 | A | | 8/1968 | Holloway |
| 3,443,578 | A | | 5/1969 | Hedin |
| 3,606,773 | A | | 9/1971 | Tabata |
| 3,698,450 | A | * | 10/1972 | Taylor et al. |
| 3,878,907 | A | * | 4/1975 | Morick |
| 4,059,013 | A | | 11/1977 | Dietrich |
| 4,323,097 | A | * | 4/1982 | Achen |
| 4,387,747 | A | * | 6/1983 | Franek et al. |
| 4,393,671 | A | | 7/1983 | Ito |
| 4,456,040 | A | * | 6/1984 | Bacroix et al. |
| 4,638,949 | A | | 1/1987 | Mancel |
| 4,789,016 | A | * | 12/1988 | Mihail |
| 4,913,198 | A | | 4/1990 | Hayahara et al. |
| 5,068,091 | A | * | 11/1991 | Toya |
| 5,086,978 | A | | 2/1992 | Fertig |
| 5,596,890 | A | | 1/1997 | Suess |
| 6,003,346 | A | | 12/1999 | Hsu |

FOREIGN PATENT DOCUMENTS

| | | |
|---|---|---|
| BE | 757253 | 7/1970 |
| CH | 354407 | 7/1957 |
| CH | 412765 | 9/1963 |
| DE | 513 285 | 11/1930 |
| DE | 2921404 | 5/1979 |
| JP | 15450 | 9/1962 |
| RU | 848509 | 7/1981 |

* cited by examiner

*Primary Examiner*—Frankie L. Stinson
(74) *Attorney, Agent, or Firm*—Calfee, Halter & Griswold LLP

(57) ABSTRACT

A dyeing machine comprises multiple dyeing beakers, a rotating support assembly mounting the beakers, a frame mounting the support assembly for moving the beakers about an axis of rotation, and a dye coupling on the frame for receipt of dye and other chemicals from a dye source. At least one beaker is provided with a dosing hose mounted on the rotating support assembly for supplying the beaker with a dye and other chemicals during movement of the rotating support assembly. In addition, a receiving end of the dosing hose is in fluid communication with the dye coupling.

18 Claims, 2 Drawing Sheets

BEAKER TYPE DYEING MACHINE

FIELD OF THE INVENTION

The present invention relates to a beaker type dyeing machine especially useful for the controlled dyeing of fabrics and other materials in a laboratory setting.

BACKGROUND

Many processes for dyeing fabrics on an industrial scale require that dyes and other chemicals be added periodically or intermittently according to some predetermined pattern or sequence. In addition, the dye bath should be suitably agitated to assure uniform dye application. The uniformity of results obtained from batch to batch often depends on the precision with which the dyes and chemicals are added, both in terms of amounts as well as timing, as well as the level of agitation received.

New dyeing processes are constantly being developed. To facilitate this work, laboratory-scale dyeing machines are available for carrying out test dyeing protocols in a laboratory setting.

In one such laboratory-scale dyeing machine, one or multiple dyeing beakers are mounted on the periphery of a rotating disc. The disc is arranged vertically while the dyeing beakers are arranged such that their longitudinal axes are close to but slightly askew from the horizontal. When the disc is rotated, a gentle agitation or "wobble" is set up in each beaker thereby providing a desired degree of agitation to the contents of the beakers.

In another type of laboratory-scale dyeing machine, which is described in commonly-assigned U.S. Pat. No. 5,596,890, each beaker is mounted for reciprocal pivoting about its longitudinal axis and a drive mechanism is also provided for causing this movement. In addition, dosing hoses are attached to each beaker for supplying the beakers with dyes and other chemicals while the machine is operating. An infrared heater is also provided for heating each beaker to speed the dyeing operation.

Although both of these dyeing machines work well, it is always desirable to provide an improved laboratory-scale dyeing machine which operates even better.

SUMMARY OF THE INVENTION

This and other objects are accomplished by the present invention in accordance with which the dyeing beakers of a rotating disc type laboratory scale dyeing machine are provided with dosing hoses for supplying dyes and other chemicals to the beakers while the machine is operating. The dosing hoses are mounted by the rotating disc assembly of the machine so that they travel with their respective beakers as these beakers move during machine operation. A fluid transfer section of the machine is designed to allow dyes and other chemicals to be directly supplied to these dosing hoses from a remote, stationary source.

With this design, dyes and other chemicals can be conveniently supplied to the beakers from a source of supply remote from the machine while the machine is continuously operating. Thus, it is unnecessary to stop machine operation for periodic or intermittent addition of chemicals, as in the case of conventional rotating disc type machines. At the same time, the inventive machine utilizes the rotating disc feature of conventional machines, which not only provides a desirable degree of agitation but also is simpler in construction than other designs.

Thus, the present invention provides a new dyeing machine for automatically dyeing multiple fabric samples in a precise, predetermined manner, the machine comprising multiple dyeing beakers, a rotating support assembly mounting the beakers, a frame mounting the support assembly for moving the beakers about an axis of rotation, and a dye coupling on the frame for receipt of dye from a dye source, wherein at least one beaker is provided with a dosing hose for supplying the beaker with a dye or other chemical during movement of the beaker, a receiving end of the dosing hose being in fluid communication with the dye coupling.

BRIEF DESCRIPTION OF THE DRAWINGS

The present invention may be more readily understood by reference to the following drawings wherein.

DETAILED DESCRIPTION

Figure 1:
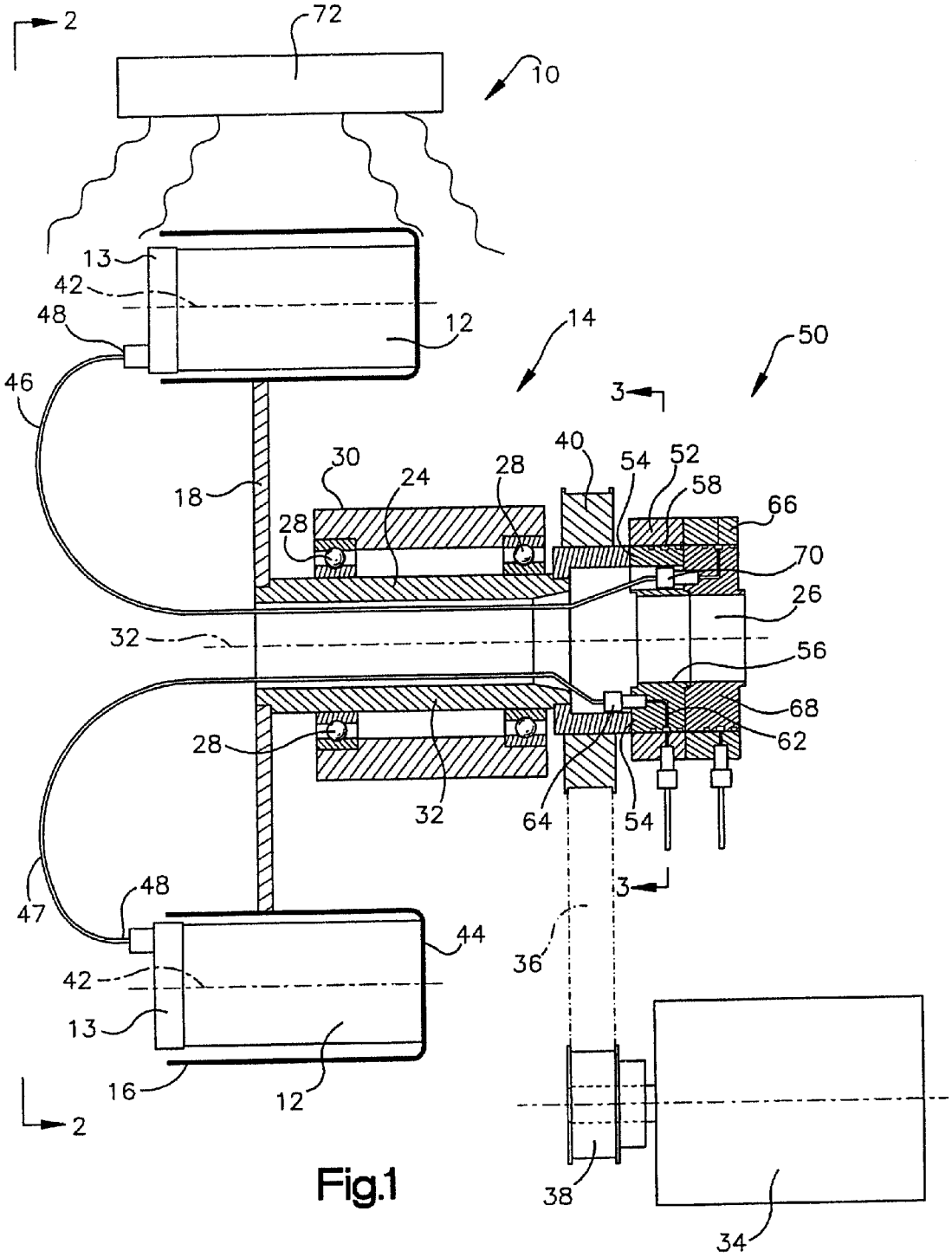
FIG. 1 is a plan view, partially in section, illustrating the dyeing machine of the present invention.

As illustrated in FIG. 1, the inventive dyeing machine, generally indicated at 10, includes multiple dyeing beakers 12, each of which is closed with a cap 13. Dyeing beakers 12 are mounted on a rotating support assembly, generally indicated at 14, which includes cup shaped holders 16 for receiving the dyeing beakers and support member 18. In the particular embodiment shown, support member 18 is composed of vertically-oriented disc 20 with cup shaped holders 16 being mounted on the periphery of this disc. See FIG. 2. Support member 18 can be formed from any other structure providing the same function, such as a support arm for each cup holder, for example.

Support assembly 14 is further defined by rotating shaft 22 connected to disc 20. In the particular embodiment shown, shaft 22 is hollow and defines a shaft bearing section 24 and a shaft supply section 26. Shaft bearing section 24 is rotably mounted by means of bearings 28 in the frame of the machine, a portion of which is shown at 30.

Support assembly 14 is mounted in frame 30 so as to rotate about axis of rotation 32, which is arranged horizontally and is coaxial with shaft 22. For this purpose, the machine is provided with motor 34 adapted to drive shaft 22 by means of drive belt 36 and drive wheels 38 and 40. Any other drive means which will cause rotation of support assembly 14 about axis 32 can be used in place of motor 34, drive belt 36 and drive wheels 38/40, as desired.

As shown in FIG. 1, each dyeing beaker 12 is mounted so that its longitudinal axis 42 is also generally horizontal. In actual practice, however, longitudinal axes 42 are slightly askew with respect to axis of rotation 32 such that the bottom 44 of each beakers is slightly closer to axis 32 than its top. With this arrangement, a gentle agitation or "wobble" is set up in the contents of each beaker as the beakers rotate about axis 32, since their angles with respect to the horizontal will change from positive to negative and back again to positive as they rotate through a full 360° of arc. Any other arrangement which also promotes gentle agitation of the beaker contents as the beakers rotate is also useful in accordance with the present invention.

In order to supply dyes and other chemicals to dyeing beakers 12, at least one dosing hose 46 is provided. Preferably, a separate dosing hose is provided for each dyeing beaker, dosing hose 47 also being shown in FIG. 1.

Figure 2:
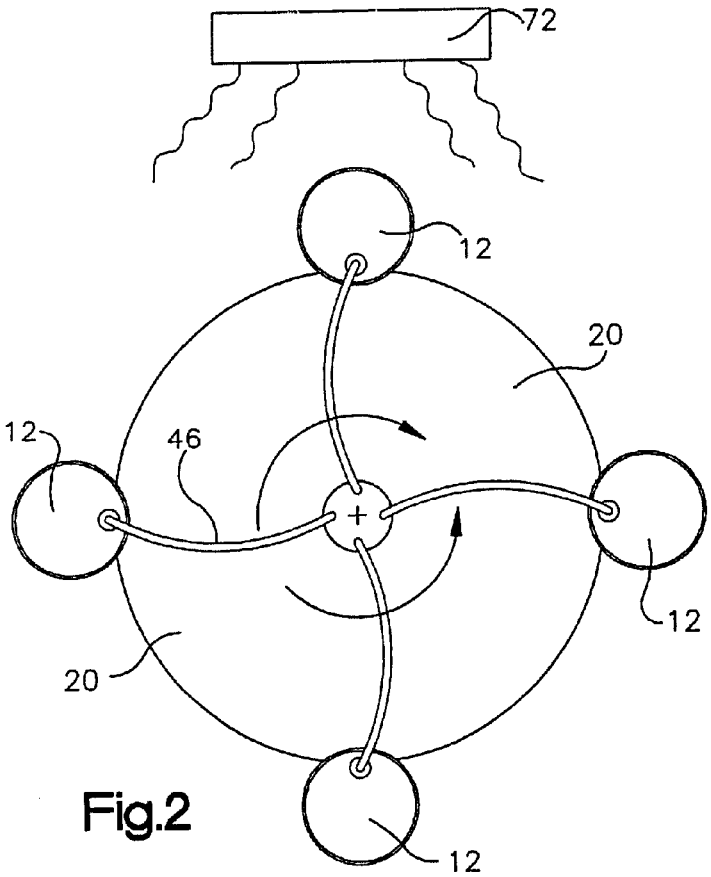
FIG. 2 is a side view of the dyeing machine of FIG. 1 as seen from the left side of FIG. 1.

As shown in FIGS. 1 and 2, a discharge end 48 of each dosing hose is in fluid communication with the interior of its respective dyeing beaker via associated cap 13. In the embodiment shown, each dosing hose passes through the hollow interior of shaft 22 where its receiving end terminates in shaft supply section 26 of the shaft.

Figure 3:
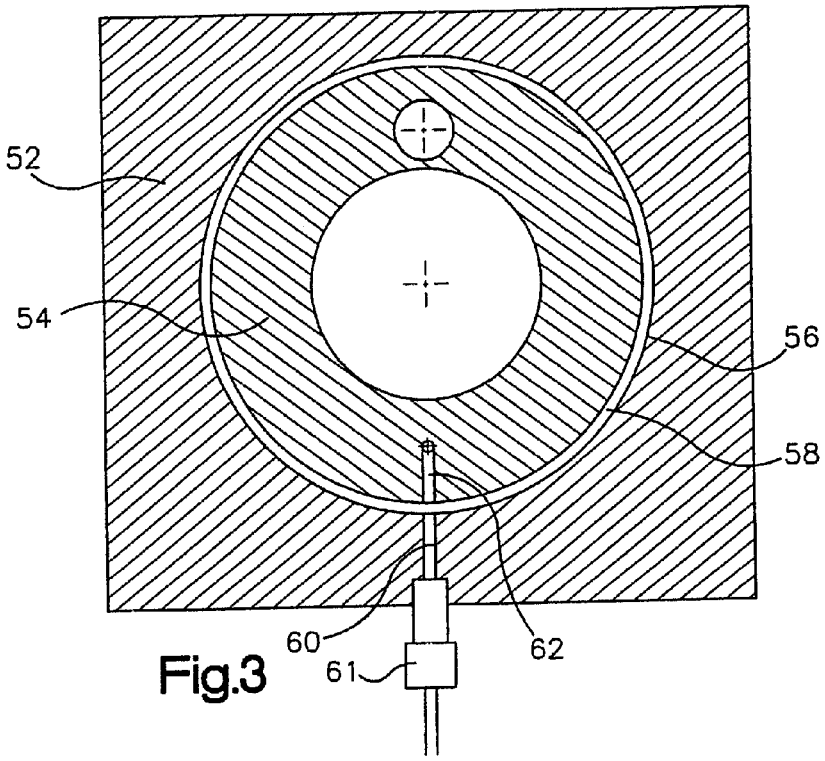
FIG. 3 is a sectional view taken on line A—A of FIG. 1.

Shaft supply section 26 of shaft 22 defines together with frame 30 a fluid transfer section of the machine, generally shown at 50, for transferring dyes from a remote source such as a container (not shown) to dosing hoses 46 and 47. To this end, frame 30 includes a first fluid transfer bearing 52, while shaft 22 defines a first fluid transfer journal or ring 54. As shown in FIGS. 1 and 3, bearing 52 and journal 54 together define mating cylindrical surfaces 56, which allow journal 54 to freely rotate with respect to bearing 52. Mating cylindrical surfaces 56 further define cylindrical groove or passageway 58 for receiving a dye or other chemical, as further discussed below. To prevent this dye or chemical from leaking, O-rings 59 and 61 are provided on both sides of this groove, as shown in FIG. 1.

To supply dye or other chemical to cylindrical groove 58, a dye channel 60 is formed in fluid transfer bearing 52. Dye channel 60 terminates on one side with dye coupling 69 for connection with a hose or other conduit attached to the remote source of dye or other chemical, while the other end of dye channel 60 communicates directly with cylindrical groove 58. See FIG. 3. Any other structure which "couples" the dye source to dye channel 60 can be used. For example, a design which allows a dye container to be directly attached to fluid transfer bearing 52 with an open communication directly to dye channel 60 can be used. Alternatively, a design in which the frame itself defines the dye reservoir, with the dye reservoir communicating with dye channel 60, can also be used.

To supply dye or other chemical from cylindrical groove 58 to the receiving end of dosing hose 47, dye channel 62 and coupling 64 are formed in journal 54. Again, any other structure which couples groove 58 to dosing hose 47 can also be used.

Mating cylindrical surfaces 56 defined in bearing 52 and journal 54 allow shaft 22 to freely rotate with respect to bearing 52, even while fluid is being transferred from the remote dye source, through fluid coupling 69, dye channel 60, cylindrical groove 58, dye channel 62 and coupling 64 to the receiving end of dosing hose 47. Accordingly, dye or other chemicals can be directly supplied to dosing hose 47, even though the rotating portions of the machine may be in constant motion and even though the dye source is remote from these rotating portions.

In the particular embodiment shown, separate dosing hoses 46 and 47 are provided for supplying the two dyeing beakers 12 illustrated in FIG. 1. These hoses can be joined together so as to supply each dyeing beaker 12 from the same remote dye source, if desired. Alternatively, these hoses can be arranged for connection to separate remote dye sources so that each beaker 12 can be separately supplied with completely different dyes and chemicals during a single operating run of the machine. To this end, fluid transfer section 50 of the machine illustrated in FIG. 1 includes second fluid transfer bearing 66 and fluid transfer journal 68. These elements have essentially the same structure as first fluid transfer bearing 52 and journal 54 but are configured to transfer dye or other chemical from a second remote dye source (not 1, shown) to the receiving end 70 of dosing hose 46.

The inventive dyeing machine, as described above, is simpler in construction and hence easier and less expensive to operate than reciprocating type machines such as illustrated in U.S. Pat. No. 5,596,890. Moreover unlike conventional rotating disc-type laboratory scale dyeing machines, the inventive machine can be operated continuously and automatically during the entire dyeing sequence, even though dyes and chemicals may be continuously or intermittently added over this period. This enables the inventive machine to mimic industrial scale conditions much more accurately, and hence allows scale up of test protocols to be done more easily, than when conventional rotating disc type machines are used.

Although only a few embodiments of the present invention have been described above, it should be appreciated that many modifications can be made without departing from the spirit and scope of the invention. For example, an optional infrared or radiant heater 72 can be provided for heating the contents of each dyeing beaker during machine operation, if desired. In addition, an automatic controller and control valves can be provided so that the machine can be programmed to operate automatically according to any predetermined dyeing recipe or scheme, as desired. In addition, pumps can be provided for pumping dyes and other chemicals from their sources to respective dye inlets of the inventive machine. All such modifications are intended to be included within the scope of the present invention, which is to be limited only by the following claims.

We claim:

1. A dyeing machine comprising multiple dyeing beakers, a rotating support assembly mounting the beakers, and a frame mounting the support assembly for moving the beakers about an axis of rotation, wherein at least one beaker is provided with a dosing hose for supplying the beaker with a dye or other chemical during movement of the rotating support assembly, the frame defining at least one dye channel for receipt of the dye or other chemical from a remote source, a receiving end of the dosing hose being in fluid communication with the dye channel, wherein the rotating support assembly includes a shaft mounted in the frame, and the machine further includes a fluid transfer section for transferring dye from the dye source to the dosing hose, and the shaft and frame together define mating surfaces in the fluid transfer section, the mating surfaces define at least one passageway for receipt of dye or other chemical and transferring the dye or other chemical to the dosing hose.

2. The machine of claim 1, wherein the dosing hose is mounted on the rotating support assembly.

3. The machine of claim 1, wherein the axis of rotation is generally horizontal.

4. The machine of claim 3, wherein each beaker defines a longitudinal axis, the beakers being mounted in the support assembly so that their longitudinal axes are slightly askew from the axis of rotation so that the contents of the beakers undergo agitation as the beakers move about this axis.

5. The machine of claim 1, wherein the mating surface in the frame is defined by a fluid transfer bearing, the fluid transfer bearing further defining the dye channel.

6. The machine of claim 5, wherein the mating surface in the shaft is defined by a fluid transfer journal, the receiving end of the dosing hose terminating in the fluid transfer journal, the fluid transfer journal further defining a supply channel communicating between the receiving end of the dosing hose and the passageway.

7. The machine of claim 6, wherein the shaft further defines a bearing section, the frame further including a bearing assembly rotably mounting the bearing section of the shaft.

8. The machine of claim 1, wherein the mating surfaces in the frame and shaft define multiple passageways.

9. The machine of claim 8, wherein a separate dosing hose is in fluid communication with each passageway, each dosing hose being in fluid communication with a different dyeing beaker.

10. The machine of claim 1, wherein each beaker is provided with a dosing hose.

11. The machine of claim 10, wherein the rotating shaft has a hollow center.

12. The machine of claim 11, wherein the dosing hoses pass through the hollow center of the rotating shaft.

13. The machine of claim 12, wherein each beaker defines a longitudinal axis, the beakers being mounted in the support assembly so that their longitudinal axes are slightly askew from the axis of rotation so that each beaker undergoes agitation as it moves about this axis.

14. The machine of claim 1, wherein the rotating support assembly comprises a rotating shaft adapted to rotate about a generally horizontal axis of rotation and a support member connected to the shaft, the support member mounting the dyeing beakers for movement around this axis.

15. The machine of claim 14, wherein the support member is composed of a support disc or at least one support arm.

16. A dyeing machine comprising multiple dyeing beakers, a rotating support assembly mounting the beakers, and a frame mounting the support assembly for moving the beakers about an axis of rotation, wherein at least one beaker is provided with a dosing hose for supplying the beaker with a dye during movement of the rotating support assembly, a receiving end of the dosing hose being adapted for fluid communication with a source of dye remote from the support assembly by means of a supply channel stationary with respect to the frame, wherein the rotating support assembly is mounted in a journal bearing carried by the frame, the journal bearing defining the supply channel.

17. A dyeing machine comprising multiple dyeing beakers, a rotating support assembly mounting the beakers, and a frame mounting the support assembly for moving the beakers about an axis of rotation, wherein at least one beaker is provided with a dosing hose for supplying the beaker with a dye or other chemical during movement of the rotating support assembly, the frame defining at least one dye channel for receipt of the dye or other chemical from a remote source, a receiving end of the dosing hose being in fluid communication with the dye channel, wherein the axis of rotation is generally horizontal, and each beaker defines a longitudinal axis, the beakers being mounted in the support assembly so that their longitudinal axes are slightly askew from the axis of rotation so that the contents of the beakers undergo agitation as the beakers move.

18. A dyeing machine comprising multiple dyeing beakers, a rotating support assembly mounting the beakers, and a frame mounting the support assembly for moving the beakers about an axis of rotation, wherein at least one beaker is provided with a dosing hose for supplying the beaker with a dye or other chemical during movement of the rotating support assembly, the frame defining at least one dye channel for receipt of the dye or other chemical from a remote source, a receiving end of the dosing hose being in fluid communication with the dye channel, wherein each beaker is provided with a dosing hose, the rotating shaft has a hollow center, the dosing hoses pass through the hollow center of the rotating shaft, and wherein each beaker defines a longitudinal axis, the beakers being mounted in the support assembly so that their longitudinal axes are slightly askew from the axis of rotating so that each beaker undergoes agitation as it moves.

* * * * *